United States Patent [19]

Nakamura et al.

[11] Patent Number: 4,945,375

[45] Date of Patent: Jul. 31, 1990

[54] PHOTOSENSITIVE MATERIAL PROCESSING APPARATUS

[75] Inventors: Takashi Nakamura, Minami-ashigara; Yasuhisa Ogawa, Hatano, both of Japan

[73] Assignee: Fuji Photo Film Co., Ltd., Kanagawa, Japan

[21] Appl. No.: 340,819

[22] Filed: Apr. 20, 1989

[30] Foreign Application Priority Data

Apr. 20, 1988 [JP] Japan ..... 63-97783
Mar. 17, 1989 [JP] Japan ..... 1-65382

[51] Int. Cl.[5] ..... G03D 3/02; G03D 3/08

[52] U.S. Cl. ..... 354/322; 354/324; 354/339; 226/189

[58] Field of Search ..... 354/316, 320, 321, 322, 354/338, 339, 324; 134/64 P, 122 P; 226/189, 199, 174, 179

[56] References Cited

U.S. PATENT DOCUMENTS

| | | | |
|---|---|---|---|
| 1,967,889 | 7/1934 | Kitroser | 226/189 |
| 2,102,843 | 12/1937 | Gwynne | 354/320 |
| 2,385,681 | 9/1945 | Brick | 134/122 P |
| 3,741,093 | 6/1973 | Komori et al. | 354/321 |

*Primary Examiner*—A. A. Mathews
*Attorney, Agent, or Firm*—Sughrue, Mion, Zinn, Macpeak & Seas

[57] ABSTRACT

In an apparatus for processing a photosensitive sheet by passing it through processing solution in a tank, vertically spaced-apart roller units are disposed in the tank for normally feeding the sheet downward and then upward at opposite sides thereof, but capable of reversing the sheet when selected. The sheet is turned around a selected roller unit whereby the length of the path that the sheet travels through the solution and hence, the duration of processing time is variable.

12 Claims, 8 Drawing Sheets

PHOTOSENSITIVE MATERIAL PROCESSING APPARATUS

BACKGROUND OF THE INVENTION

This invention relates to photosensitive material processing apparatus, and more particularly photosensitive material processing apparatus for use as a developing apparatus and a pre- and post-processing apparatus (e.g., bleach-fix and washing apparatus) associated therewith destined for silver salt photographic copying machines and automatic developing machines.

Silver salt photographic copying machines are of the type wherein an original image is duplicated on a photosensitive material. One of their advantages over electostatographic copying machines is that an image of higher quality can be duplicated.

In general, silver salt photographic copying machines are designed such that a photosensitive material is fed from a magazine to an exposure zone where it is exposed to an original image, and then to a processing zone where the exposed photosensitive material is developed, producing an image. The processing zone usually includes at least three serially arranged tanks, developing, bleach-fix and washing tanks through which the exposed photosensitive material is successively passed in this order, completing development.

For the purposes of effecting sensitization or desensitization and achieving optimum development for a particular type or developing characteristic of photosensitive material during the development process, it is often desirable to vary the duration of time when the photosensitive material is dipped in a developing solution in the developing tank. A prior art approach for dipping duration control is by varying the rate of transfer of the photosensitive material because the path that the material travels in the tank is of a fixed length.

This approach has a drawback because the rate of transfer of the photosensitive material must be equal throughout the processing zone. If the transfer rate is slowed down for the purpose of sensitization, for example, the photosensitive material is passed through the succeeding bleach-fix and washing tanks at the same slow speed. The entire processing time is correspondingly increased.

Then another approach which can be contemplated for dipping duration control is by varying the length of the path in the tank rather than varying the rate of transfer of the photosensitive material. This approach may be practiced in two forms. In one form, the processing zone is provided with a plurality of developing tanks having paths of different lengths, and the photosensitive material is carried into a selected tank. In the other form, there are prepared a plurality of developing tanks having paths of different lengths, and the processing zone is loaded with a selected tank. The former requires an increased space for accommodating a plurality of developing tanks. The latter requires a cumbersome and time-consuming operation for tank replacement whenever the developing conditions must be changed. Both methods are almost unfeasible for actual copying machines.

SUMMARY OF THE INVENTION

A primary object of the present invention is to provide a novel and improved photosensitive material processing apparatus which has overcome the above-mentioned problems of the prior art and which by itself can vary the duration of processing time without varying the rate of transfer of photosensitive material.

According to a first aspect of the present invention, there is provided a photosensitive material processing apparatus comprising a tank containing processing liquid therein, and means for passing photosensitive material through the liquid along a path having a variable length. The means for passing photosensitive material through the liquid along a path having a variable length includes means for passing photosensitive material through the liquid along a path, and means for varying the length of the path.

In one preferred embodiment of the apparatus, a switchable roller unit is disposed at one or more stages in the tank. The switchable roller unit includes a rotating main roller, a reverse guide disposed below the main roller, and a guide roller movable between a reverse position where the photosensitive material is turned back along the reverse guide and a forward position where the photosensitive material is moved forward without direction change. A fixed roller unit is disposed at the lowest stage in the tank, including a main roller, a reverse guide disposed below the main roller, and a guide roller for guiding the photosensitive material such that it is turned back along the reverse guide. Then the travel direction of the photosensitive material is reversed by selected one of the switchable roller unit(s) and the fixed roller unit to vary the length of the path for the material.

In another preferred embodiment of the apparatus, a reverse roller unit is disposed for vertical motion in the tank. The reverse roller unit includes a rotating main roller, a reverse guide disposed below the main roller, and a guide roller for introducing the photosensitive material between the main roller and the reverse guide to turn it back along the reverse guide.

In a further preferred embodiment of the apparatus, a plurality of suction roller units are disposed in the tank. Each of the suction roller units includes a rotating main roller in the form of a hollow cylinder having perforations in the circumferential surface and a provision is made such that only those perforations in a lower half area may act as suction ports. Suction means selectively generates negative pressure in the interior space of the cylinder of a selected roller unit. Then the photosensitive material is turned back at the selected roller unit while it is being attracted to the perforated surface of the rotating roller cylinder, thereby varying the length of the path for the photosensitive material.

According to a second aspect of the present invention, there is provided a photosensitive material processing system comprising a plurality of photosensitive material processing apparatus as set forth above arranged in series with respect to the passage of the photosensitive material. Selected sets of apparatus are respectively assigned to different processing purposes. The path length varying means is controlled for each of the apparatus whereby the duration of processing time for the photosensitive material is variable for each of the apparatus.

In one preferred embodiment, selected sets of photosensitive material processing apparatus are assigned as developing apparatus and post-processing apparatus, respectively.

Alternatively, in a photosensitive material processing system comprising a developing section for developing photosensitive material and a subsequent section for post-processing the developed material, a photosensitive material processing apparatus as set forth above may be provided in the developing section.

BRIEF DESCRIPTION OF THE ACCOMPANYING DRAWINGS

The above and other objects, features and advantages of the present invention will be better understood from the following description taken in conjunction with the accompanying drawings, in which.

DESCRIPTION OF THE PREFERRED EMBODIMENTS

Figure 1:
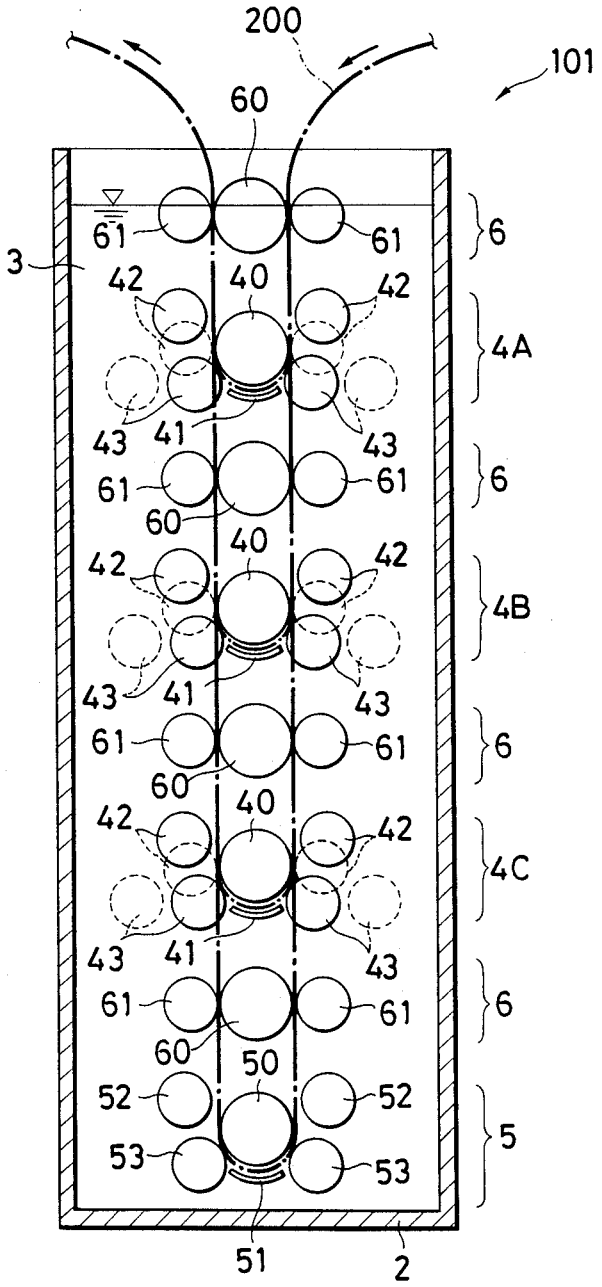
FIGS. 1, 2 and 3 are cross-sectional views of photosensitive material processing apparatus according to preferred embodiments of the present invention.

Referring to FIG. 1, there is illustrated in side elevation a photosensitive material processing apparatus according to a first embodiment of the invention. The photosensitive material processing apparatus generally designated at 101 includes a vertical elongated processing tank 2 in which a processing solution 3 is contained to a predetermined level. Although only one tank is illustrated, the apparatus may include more than one tank. The type of processing solution depends on the intended use of the apparatus described later, and may generally be selected from a developing solution for photosensitive material development and bleach-fix solution and wash liquid, typically water used after the development. The apparatus of the invention may find applications in processings other than the development, bleach-fix and washing mentioned above, for example, such as in reversal, compensation, stabilization, and stop baths.

The photosensitive material processing apparatus 101 is designed to process photosensitive material in the form of a sheet or web 200 by dipping the sheet in the solution 3 in the tank. To this end, a series of rollers are disposed in the tank 2 for carrying the photosensitive sheet 200 into and out of the solution. These rollers may be classified into the following units.

As shown in FIG. 1, a plurality of roller units are disposed in the tank at a predetermined spacing therebetween in a depth or vertical direction of the tank. More particularly, switchable roller units 4A, 4B and 4C are disposed at vertically spaced-apart stages from the top in this order and a fixed roller unit 5 is disposed at the bottom stage. Between the switchable and fixed roller units 4A, 4B, 4C and 5 and above the top switchable roller unit 4A are disposed relay roller units 6. A substantially vertical downward or forward path and a substantially vertical upward or backward path interconnected by an arcuate path are defined at the opposite sides of the roller units as shown by dot-and-dash lines.

Each of the switchable roller units 4A, 4B and 4C includes a rotating main roller 40 at the center, a reverse guide 41 disposed below the main roller 40, and first and second pairs of guide rollers 42 and 43 disposed on horizontally opposed sides of the main roller 40. The main roller 40 has a relatively large diameter and is driven by suitable drive means (not shown) so as to rotate clockwise as viewed in FIG. 1. The reverse guide 41 may be a member having an arcuate concave surface in conformity with the circumferential surface of the main roller 40, for example, a bent plate, and defines a narrow arcuate pathway between the guide and the main roller. The reverse guide 41 leads the photosensitive sheet 200 such that the sheet moves along the arcuate surface of the guide to change its travel direction from a downward to an upward direction.

The guide rollers 42 and 43 may be either driven rollers or idle (free rotating) rollers as long as they can clamp the sheet 200 between them and the main roller 40. The guide rollers 42 and 43 must be movable between a first position shown by solid lines in FIG. 1 (to be referred to as a reverse position, hereinafter) and a second position shown by broken lines in FIG. 1 (to be referred to as a forward position, hereinafter) under control of a suitable switch, for example. In the reverse position, the first pair of guide rollers 42 are moved away from the path, but the second pair of guide rollers 43 come in close contact with the main roller 40 at the opposed ends of the reverse guide 41 to lead the sheet 200 into the pathway between the reverse guide 41 and the main roller 40 so that the sheet is turned back while moving along the reverse guide. In the forward position, the first pair of guide rollers 42 come in close contact with the main roller 40 at the opposed ends thereof, but the second pair of guide rollers 43 are moved away from the path. A tangent at the contact between the first guide rollers 42 and the main roller 40 is in register with the vertical path so that the sheet 200 is fed straight forward or downward without changing its direction.

The first and second pairs of guide rollers 42 and 43 may be moved in cooperation or independently. The means for moving the guide rollers 42 and 43 between the reverse and forward feed positions is not critical and any desired wellknown mechanism or drive may be used for the purpose.

The fixed roller unit 5 is disposed at the bottom of the tank. The fixed roller unit 5 includes a rotating main roller 50 at the center, a reverse guide 51 disposed below the main roller 50, and first and second pairs of guide rollers 52 and disposed on horizontally opposed sides of the main roller 40. The main roller 50 has a relatively large diameter and is driven by suitable drive means (not shown) so as to rotate clockwise as viewed in FIG. 1. The reverse guide 51 may be a member having an arcuate concave surface in conformity with the circumferential surface of the main roller 40, for example, a bent plate, and defines a narrow arcuate pathway between the guide and the main roller. The reverse guide 51 leads the photosensitive sheet 200 such that the sheet moves along the arcuate surface of the guide to change its travel direction from a downward to an upward direction.

The guide rollers 52 and 53 may be either driven rollers or idle rollers as long as they can clamp the sheet 200 between them and the main roller 50. As opposed to the abovementioned guide rollers 42 and 43 which are movable, these guide rollers 52 and 53 are fixed. The guide rollers 53 are in close contact with the main roller 50 at the opposed ends of the reverse guide 51 to lead the sheet 200 into the pathway between the reverse guide 51 and the main roller 50 so that the sheet is turned back while moving along the reverse guide. The other guide rollers 52 only assist in progress of the sheet and may be omitted.

Each of the relay roller units 6 includes a rotating main roller 60 at the center and a pair of guide rollers 61 disposed on opposite sides of the main roller 60 to clamp the sheet 200 between the main roller 60 and the guide rollers 61. The main roller 60 and the guide rollers 61 may be either idle or driven rollers.

In the photosensitive material processing apparatus 101 as constructed above, the main and guide rollers are preferably formed of a chemical resistant material, that is, resistant against the processing solution used in the tank. Examples of the chemical resistant material include various rubbers such as neoprene rubber, butadiene-neoprene copolymers, butadiene, and natural rubber, various resins such as phenolic resins, vinyl chloride resins, polyethylene, polypropylene, and nylon, various ceramics materials such as alumina, and corrosion resistant metals such as stainless steel, titanium and titanium alloys and Hastelloy.

In the illustrated embodiment, the photosensitive material processing apparatus 101 includes four stages of roller units, that is, the switchable roller units 4A, 4B, and 4C at upper three stages and the fixed roller unit 5 at the bottom stage. The number of roller unit stages is not particularly limited as long as at least one switchable roller unit stage and one fixed roller unit stage are set in place.

The operation of the photosensitive material processing apparatus 101 of the above construction is described below.

The photosensitive material in the form of a sheet 200 is carried through the tank 2 in the arrow direction by driving all or some of the main rollers of the units to rotate clockwise as viewed in FIG. 1.

Prior to the supply of the sheet 200, a selection is made such that either one of the switchable roller units 4A, 4B, and 4C sets the first and second pairs of guide rollers 42 and 43 to the reverse position, or all of the switchable roller units 4A, 4B, and 4C set the first and second pairs of guide rollers 42 and 43 to the forward position. Then the sheet 200 which has been traveling down through the tank 2 is turned back and moved upward at the selected movable roller unit 4A, 4B or 4C having the guide rollers 42 and 43 set to the reverse position or at the fixed roller unit 5.

By selecting the location at which the sheet 200 is turned back from the switchable roller units 4A, 4B, and 4C and the fixed roller unit 5, the length of the path that the sheet 200 travels within the tank (sometimes simply referred to as path length) can be varied stepwise.

Figure 2:
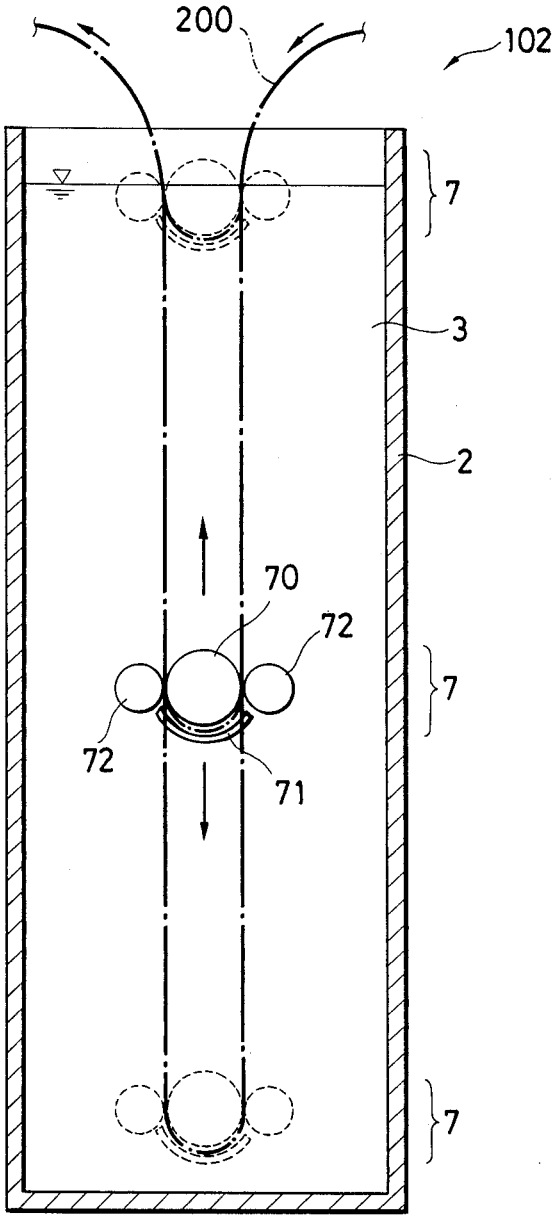

FIG. 2 illustrates in side elevation a photosensitive material processing apparatus according to a second embodiment of the invention. The apparatus generally designated at 102 includes a vertical elongated tank 2 similar to that of the first embodiment, containing processing solution therein. In this embodiment, only a reverse roller unit 7 is disposed for vertical motion in the tank 2.

The movable reverse roller unit 7 includes a rotating main roller 70 at the center, a reverse guide 71 disposed below the main roller 70, and a pair of guide rollers 72 disposed on opposite sides of the main roller 70. The main roller 70 has a relatively large diameter and is driven by suitable drive means (not shown) so as to rotate clockwise as viewed in FIG. 2. The reverse guide 71 may be a member having an arcuate concave surface in conformity with the circumferential surface of the main roller 70, for example, a bent plate, and defines a narrow arcuate pathway between the guide and the main roller. The reverse guide 71 leads the photosensitive sheet 200 such that the sheet moves along the arcuate surface of the guide to change its travel direction from a downward to an upward direction.

The guide rollers 72 may be either driven rollers or idle rollers. These guide rollers 72 are in close contact with the main roller 70 at the opposed ends of the reverse guide 71 to clamp the sheet 200 between the guide rollers 72 and the main roller 70, thereby leading the sheet 200 into the pathway between the reverse guide 71 and the main roller 70 so that the sheet is turned back while moving along the reverse guide.

In this photosensitive material processing apparatus 102, the reverse roller unit 7 is vertically moved from the top to the bottom of the tank 2 (both positions being shown by broken lines in FIG. 2), thereby varying the path length of the sheet 200 continuously or stepwise.

The means for vertically moving the reversing roller unit 7 (not shown) may be any of well-known mechanisms, for example, electric motors, hydraulic cylinders, and pneumatic cylinders as long as the entire unit 7 can be moved up and down. Guide rails for guiding the roller unit 7 for vertical motion may be provided in the tank 2 as well as guide rollers or auxiliary rollers for transfer of the sheet (although these components are not shown).

FIGS. 3 through 8 illustrate a photosensitive material processing apparatus according to a third embodiment of the invention.

The photosensitive material processing apparatus generally designated at 103 includes a plurality of vertically spaced-apart suction roller units, in the illustrated embodiment, four stages of suction roller units 21A to 21D. The path length of the photosensitive sheet 200 may be varied by selecting either one of the vertically spaced-apart suction roller units 21A to 21D.

Each of the suction roller units 21A to 21D includes a main roller assembly 210 including a rotating hollow roller cylinder 211 and a stationary suction restricting member 221 on which the roller cylinder 211 is rotatably mounted, a pair of guide rollers 240 and 241 disposed at horizontally opposed ends of the main roller assembly 210, that is, at carry-in and out ends of the main roller, and a blade 250 disposed adjacent the carry-out end of the main roller assembly 210 for separating the sheet 200 from the main roller assembly 210 after reversal.

Figure 4:
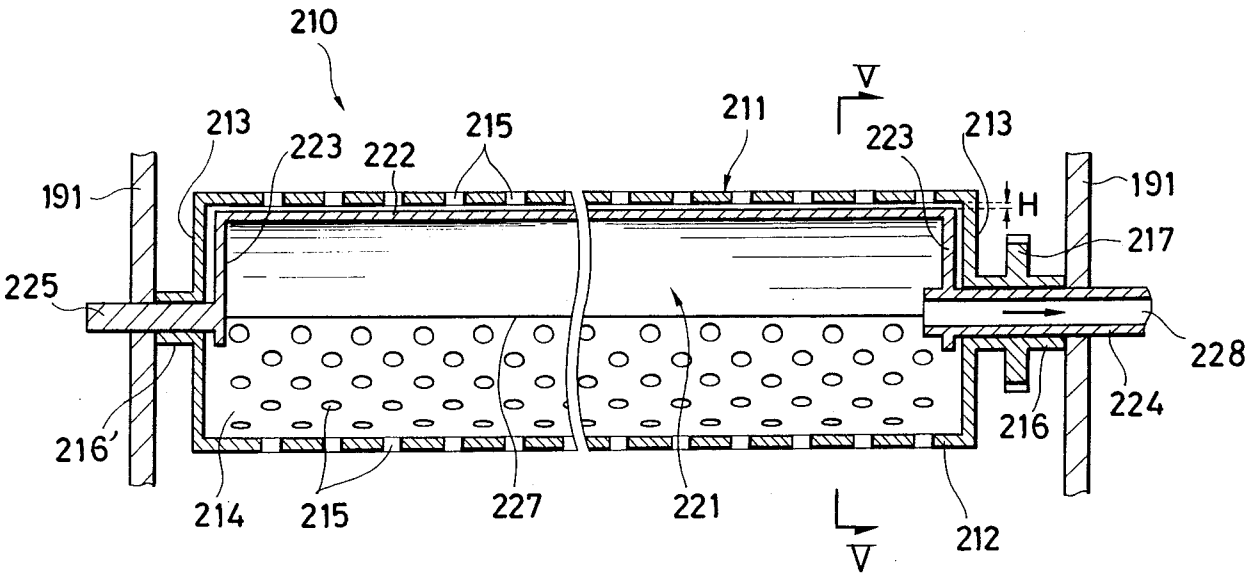
FIG. 4 is an axial cross-sectional view showing the structure of a main roller assembly used in the apparatus of FIG. 3.

The roller cylinder 211 of the main roller assembly 210 is illustrated in FIG. 4 as having a cylindrical wall 212 and axially opposed side walls 213 connected to the opposed ends of the wall 212. The cylindrical wall 212 defines an interior space 214 with the side walls 213. The cylindrical wall 212 is formed with a plurality of suction ports 215 through which the processing solution 3 in the tank 2 is admitted from the exterior to the interior space of the roller cylinder 211.

The dimensions, number, and distribution of the suction ports 215 may be properly determined depending on the negative pressure which can be generated in the interior space of the roller cylinder 211. Preferably, the suction ports 215 are substantially uniformly distributed throughout the roller circumferential surface.

The roller cylinder 211 is provided at the side walls 213 with axially projecting hollow hubs 216 and 216' which are journaled on support shafts 224 and 225 of the suction restricting member 221, respectively. At least one of the hollow hubs 216 and 216', the hub 216 in the illustrated embodiment, is provided with a gear 217 which is operatively coupled to drive means for carrying the photosensitive sheet (not shown). The gear 217 may be formed integral with the hub 216 or attached to the hub 216 by mechanical fastening.

Figure 5:
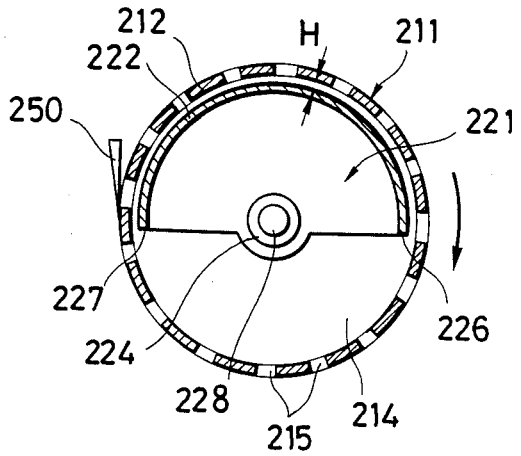
FIG. 5 is a transverse cross-sectional view of the main roller assembly taken along lines V—V in FIG. 4.
Figure 6:
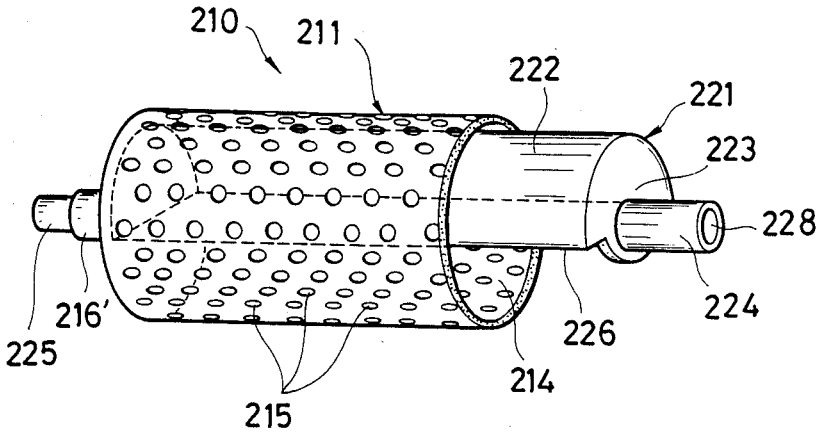
FIG. 6 is a perspective view of the main roller assembly of FIG. 4.

The suction restricting member 221 is a sector member, as shown in FIGS. 5 and 6, including a semi-cylindrical cover wall 222 facing and conforming to the inner surface of the cylindrical wall 212 of the roller cylinder 211 and having diametrically opposed edges 226 and 227. Sector side walls 223 are connected to the axially opposed ends of the cover wall 222. The sector member 221 is provided at the side walls 223 with axially projecting support shafts 224 and 225. The support shafts 224 and 225 extend through the hubs 216 and 216' of the roller cylinder 211 to rotatably support the roller cylinder 211 and are secured to opposed side plates 191 of a rack structure to fixedly support the sector member 221.

The suction restricting member 221 has the function that the suction force applied to the main roller assembly 210 can exert only on a lower half of the outer wall of the roller cylinder 211, but not on an upper half of the cylinder outer wall.

The suction restricting member 221 cooperates with the perforated roller cylinder 211, to the interior space of which a suction force is applied, such that the incoming photosensitive sheet 200 is turned around the main roller assembly 210 from a downward to an upward direction. This is accomplished by attracting the incoming sheet 200 to the outer surface of the roller cylinder 211 in proximity to the carry-in position of the main roller assembly 210. The sheet 200 is turned about the cylinder axis with the sheet 200 adhered to a lower half of the roller cylinder outer surface due to the suction force applied thereto. Finally, attraction of the sheet 200 is cancelled in proximity to the carry-out position of the main roller assembly 210 to release the sheet 200 from the roller cylinder outer surface.

The semi-cylindrical cover wall 222 of the suction restricting member 221 is faced up and radially spaced a small distance H from the inner surface of the cylindrical wall 212 of the roller cylinder 211 over its entire length so as to substantially prevent admission of processing solution from the exterior to the interior of the roller cylinder 211 through those suction ports 215 which are then positioned in an upper half region of the roller cylinder 211. The diametrically opposed edges 226 and 227 of the cover wall 222 are set at a level corresponding to the carry-in and out positions of the main roller assembly 210, that is, the contacts thereof with the guide rollers 240 and 241.

The support shafts 224 and 225 are fixedly secured to the rack side walls 191 to place the cover wall 222 in upward convex position, that is, to place the diametrically opposed edges 226 and 227 in a horizontal plane.

The support shaft 224 which is shown at the right side in FIG. 4 is a hollow shaft which defines a flowpath 228 for fluid communication between the interior space 214 of the roller cylinder 211 and branches 232A to 232D of circulating suction means 230 described later. The circulating suction means 230 operates to generate a negative pressure in the interior space 214 of the roller cylinder 211, providing the main roller assembly 210 with a suction force only at the then lower half region of the roller cylinder 211 where the semi-cylindrical wall 222 does not cover.

The rack side walls 191 are to support the suction roller units 21A to 21D in place in the tank. Such side walls may be a pair of side plates.

Figure 7:
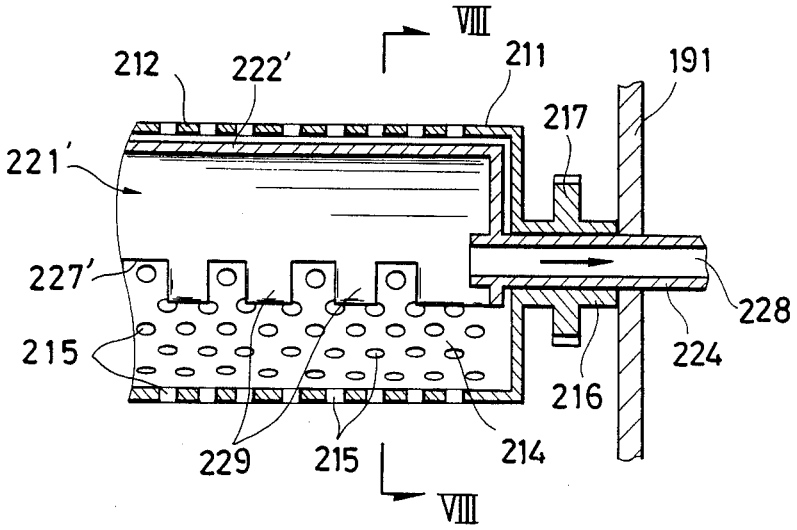
FIG. 7 is an axial cross-sectional view showing another example of the suction restricting member used in the main roller assembly.
Figure 8:
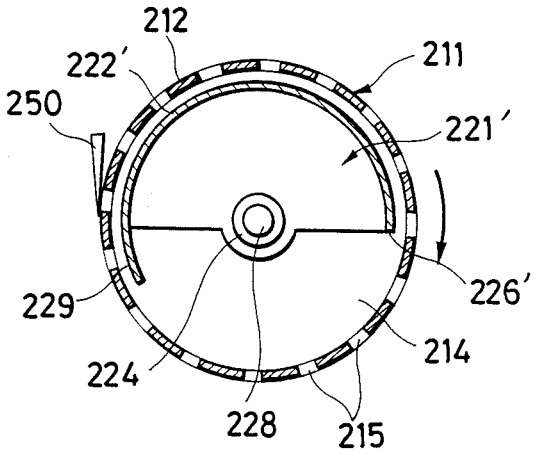
FIG. 8 is a transverse cross-sectional view of the main roller assembly taken along lines VIII—VIII in FIG. 7; and FIGS. and 10 ar partially cut-away elevations of photosensitive material processing systems according to different embodiments of the present invention.

FIGS. 7 and 8 illustrate another example of the suction restricting member. This suction restricting member 221' is similar to the suction restricting member 221 of FIGS. 4 to 6, but different therefrom in that suction force adjusting means is provided. That is, one edge of the cover wall disposed adjacent the carry-out position of the main roller assembly is digitated as opposed to the straight edge 227 of the previous embodiment.

The suction force adjusting means is in the form of a plurality of axially spaced-apart tongues 229 formed in one edge 227' of the semi-cylindrical cover wall 222' disposed adjacent the carry-out position of the main roller assembly 210. Briefly stated, the edge 227 is comb shaped.

With this comb-shaped cover wall, among those suction ports 215 positioned near the edge 227' on the outlet side, some are covered with the tongues 229, but the remainings are uncovered. Only those uncovered ports allow suction of the processing solution therethrough into the cylinder interior. Then the suction force developed near the comb-shaped edge 227 of the cover wall 222' at the outlet side of the roller assembly 210 is lower than that developed in a lower half region of the roller cylinder 211 including the edge 226' at the inlet side. This suction force adjustment has a benefit as described below.

In the embodiment shown in FIGS. 4 to 6, an approximately equal suction force is developed through the suction ports 215 over the region where the cover wall 222 is absent, that is, the lower half region of the roller cylinder 211. If the suction force is somewhat increased to ensure that the photosensitive sheet 200 is attracted to the outer surface of the roller cylinder 211, then a correspondingly increased suction force is also developed near the edge 227 on the outlet side, which will often disturb smooth separation of the sheet 200 from the outer surface of the roller cylinder 211. The embodiment shown in FIGS. 7 and 8 is advantageous in this respect. The sheet 200 is wrapped around the main roller assembly 210 with a sufficient suction force to attract the sheet to the outer surface of the roller cylinder 211. As the sheet 200 approaches the outlet position, the suction force is reduced so that the sheet can be smoothly stripped off from the outer surface of the roller cylinder 211.

Although the tongues 229 of a rectangular shape are illustrated, they may take a semi-circular, triangular or any other shape.

Also, the suction force adjusting means is not limited to the above configuration. For example, the cover wall 222 may be circumferentially and radially inwardly extended a small distance from the edge 227 on the outlet side such that the spacing H between this extension and the cylindrical wall 212 is larger than the original spacing H between the cover wall 22 and the cylindrical wall 212.

Instead of accommodating the suction restricting member 221 in the roller cylinder 211, it is possible to provide an enclosure, for example, a semi-cylindrical shield member on the outer surface of the roller cylinder 211 so as to cover the upper half thereof.

Figure 3:
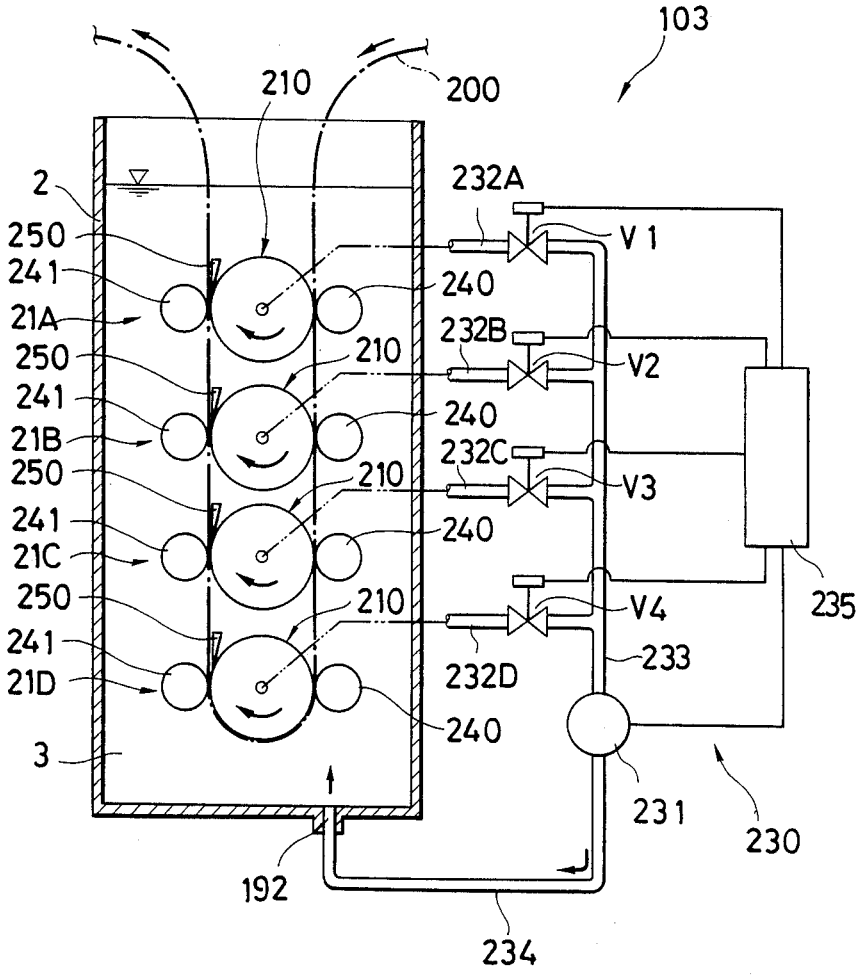

The circulating suction means 239 for generating negative pressure in the interior space 214 of the roller cylinder 211 is commonly connected to all the main roller assemblies 210 of the suction roller units 21A to 21D. A typical arrangement of the suction means 230 is illustrated in FIG. 3 as including a pump 231. Branch lines 232A to 232D each are connected to the hollow support shaft 224 of the suction restricting member 221 (or 221') of each main roller assembly 210. Valves V1 to V4 are disposed in the branch lines 232A to 232D and they are typically electromagnetic (but may be manual). A main line 233 is connected between the branch lines 232A to 232D and the suction port of the pump 231. Another main line 234 is connected between the discharge port of the pump 231 and a discharge port in the bottom of the tank 2. A control 235 is electrically connected to the valves V1 to V4 and the pump 231 for controlling their operation.

In a preferred embodiment, the control 235 is a microcomputer which is previously programmed such as to actuate the pump 231 at the same time as the start of feeding of the photosensitive sheet 200 and to control the operation of the electromagnetic valves V1 to V4 according to the operational mode shown in Table 1 below.

TABLE 1

| | Electromagnetic values | | | |
|---|---|---|---|---|
| | V1 | V2 | V3 | V4 |
| No selection | ON | ON | ON | ON |
| Roller unit selected | | | | |
| 21A | ON | OFF | OFF | OFF |
| 21B | OFF | ON | OFF | OFF |
| 21C | OFF | OFF | ON | OFF |
| 21D | OFF | OFF | OFF | ON |

It will be understood that the pump 231 is illustrated as a typical example of the means for generating negative pressure in the interior space 214 of the roller cylinder 211, and that the electromagnetic valves V1 to V4 are illustrated as a typical example of the means for selective connection or disconnection between the roller cylinders 211 and the pump 231. For both the components, any other desired forms may be employed which can provide the equivalent functions. It is also possible to provide the suction roller units with separate circulation systems each including a pump and a delivery line, the systems being selectively operated.

In the suction roller units 21A to 21D, the four pairs of guide rollers 240 and 241 are supported by the rack side walls 191 (FIG. 4) such as to contact the outer surface of the corresponding roller cylinders 211 at the carry-in and out positions of the main roller assemblies 210. These guide rollers 240 and 241 may be driven for rotation by drive means as described above or they may be idle rollers which rotate with the main rollers.

As are the rollers in the embodiment shown in FIG. 1, the roller cylinder 211, suction restriction member 221, and guide rollers 240 and 241 are preferably formed of suitable material having chemical resistance to the processing solution 3 in the tank 2.

The blade 250 is disposed in the vicinity of the carry-out position of the main roller assembly 210 such that the blade tip may softly contact the perforated outer surface of the roller cylinder 211. The blade 250 can then function to separate the photosensitive sheet 200 from the perforated outer surface of the roller cylinder 211 after completion of reversal. The blade 250 may be formed of the same material as the rollers. The blade 250 which longitudinally extends parallel to the axis of the roller cylinder 211 is directed approximately tangent to the roller cylinder 211 in the illustrated embodiment although the blade may be directed at any desired angle with respect to the tangent to the roller cylinder.

When it is desired to vary the length of the path the photosensitive sheet 200 travels in the apparatus 103 mentioned above, one roller unit which can provide the desired path length is selectively actuated among the four suction roller units 21A to 21D. Assume that the roller unit 21B at the second stage is selected. On the basis of Table 1, the desired mode is selected from the operation modes for the control means 235, in this example, the operation mode in which only the electromagnetic valve V2 corresponding to the roller unit 21B is open and the remaining electromagnetic valves V1, V3, and V4 are closed.

To initiate processing of a photosensitive sheet, the apparatus 103 is turned on to actuate the drive means for carrying the photosensitive sheet and the pump 231. Thus the roller cylinders 211 of the roller units 21A to 21D rotate while the pump 231 applies negative pressure to the interior space 214 of the roller cylinder 211. If the operation mode is in non-selective state at this point, all the electromagnetic valves V1 to V4 are open and negative pressure prevails in all the interior spaces 214 of the roller cylinders 211. The processing solution 3 in the tank 2 is admitted into the interior space 214 of each roller cylinder 211 through those suction ports 215 in the lower half area of the roller cylinder outer surface. The solution then passes a route connecting flowpaths 228 in support shafts 224 - branch lines 232A to 232D - main line 233 - pump 231 - main line 234 and finally re-enters the tank 2 through the discharge port 192 at the tank bottom. As a result of this circulation, the processing solution is agitated in the tank. The amount of processing solution circulated with all the electromagnetic valves V1 to V4 set open is preferably in the range of from 1/10 to an equal volume to the tank volume per minute, more preferably from $\frac{1}{2}$ to $\frac{1}{4}$ of the tank volume per minute. A choice is now made of the desired operation mode in which only the electromagnetic valve V2 at the second stage is open and the remaining valves V1, V3, and V4 are closed. Suction is applied by the pump 231 to only the main roller assembly 210 of the roller unit 21B while the remaining main roller assemblies 210 to which no suction is applied play the role of a simple feed roller.

The photosensitive sheet 200 incoming from the top of the tank travels straight forward past the roller unit 21A at the first stage between the roller cylinder 211 and the carry-in roller 240 in rotating engagement and reaches the roller unit 21B at the second stage. Since the suction force from the pump 231 is being applied to the main roller assembly 210 of this roller unit 21B, the leading edge of the sheet 200, immediately after leaving the feed engagement between the roller cylinder 211 and the carry-in roller 240, is attracted to the outer surface of the roller cylinder 211 due to the suction through the ports 215 in the cylinder surface which are then positioned in the lower half area of the roller cylinder. Since no suction is applied to the upper half area of the roller cylinder 211 outer surface due to the presence of the cover wall 222 or 222', there is no likelihood that the sheet 200 is erroneously attracted to the upper half area.

While being attracted to the roller cylinder outer surface, the sheet 200 travels the lower half area of the roller cylinder 211 with the rotation thereof, changes its traveling direction from downward to upward, and reaches between the roller cylinder 211 and the carry-out roller 241. Since the edge 227 of the cover wall 222 of the suction restricting member 221 is present near the carry-out position, the suction available on the roller cylinder 211 is abruptly reduced and eventually lost. It will be understood that in the case of the modified cover wall 222' in the embodiment of FIGS. 7 and 8, the presence of tongues 229 causes the suction force to be gradually reduced near the carry-out position, facilitating separation of the sheet 200 from the roller cylinder 211.

Since the leading edge of the photosensitive sheet 200 is free or under no suction at this point, the sheet is separated away from the outer surface of the roller cylinder 210 with the aid of the blade 250, leaving the main roller assembly 210. Thereafter, the sheet 200 travels upward, passes the roller unit 21A at the first stage between its roller cylinder 211 and the carry-out roller 241, and finally exits the tank 2 through its top opening to a subsequent station. This upward travel of the sheet 200 is also caused by the driving forces provided by the suction roller units 21B and 21A rotating in frictional engagement with the carry-out rollers 241.

The amount of processing solution circulated in this mode with only one electromagnetic valve V2 set open is preferably in the range of from ⅛ to an equal volume to that with all the valves open.

In this mode, the photosensitive sheet 200 enters the tank at the right of its top opening, travels downward through processing solution, turns around the roller unit 21B at the second stage, then travels upward, and leaves the tank at the left of its top opening as shown in FIG. 3. The selection of the second unit 21B provides the desired path length which is given as the sum of downward travel plus turn plus upward travel.

This is true for any of the remaining suction roller units 21A, 21C, and 21D when it is selected for the desired path length.

In this way, the photosensitive material processing apparatus 103 enables the variation the path length for the photosensitive material in the tank in four steps corresponding to the location of vertically spaced-apart roller units 21A to 21D in the tank 2.

In the photosensitive material processing apparatus 103 shown in FIG. 3, the suction roller unit 21D at the fourth or lowest stage may be replaced by a fixed roller unit 5 as illustrated in FIG. 1. In this arrangement, when it is desired to turn back the photosensitive sheet 200 at any one of suction roller units 21A, 21B, and 21C, a corresponding one of electromagnetic valves V1, V2 and V3 is selectively opened. When it is desired to turn back the sheet 200 at the fixed roller unit at the lowest stage, the pump 231 is turned off, interrupting suction force on the suction roller units 21A, 21B, and 21C.

Also in the photosensitive material processing apparatus 103 shown in FIG. 3, one or more relay roller units 6 as illustrated in FIG. 1 may be disposed between the suction roller units 21A to 21D.

In the photosensitive material processing apparatus, the means for varying the path length is not limited to the abovedescribed embodiments. Any arrangements that would occur to those skilled in the art may be employed as long as they can vary the path length for photosensitive material stepwise or continuously.

Figure 9:
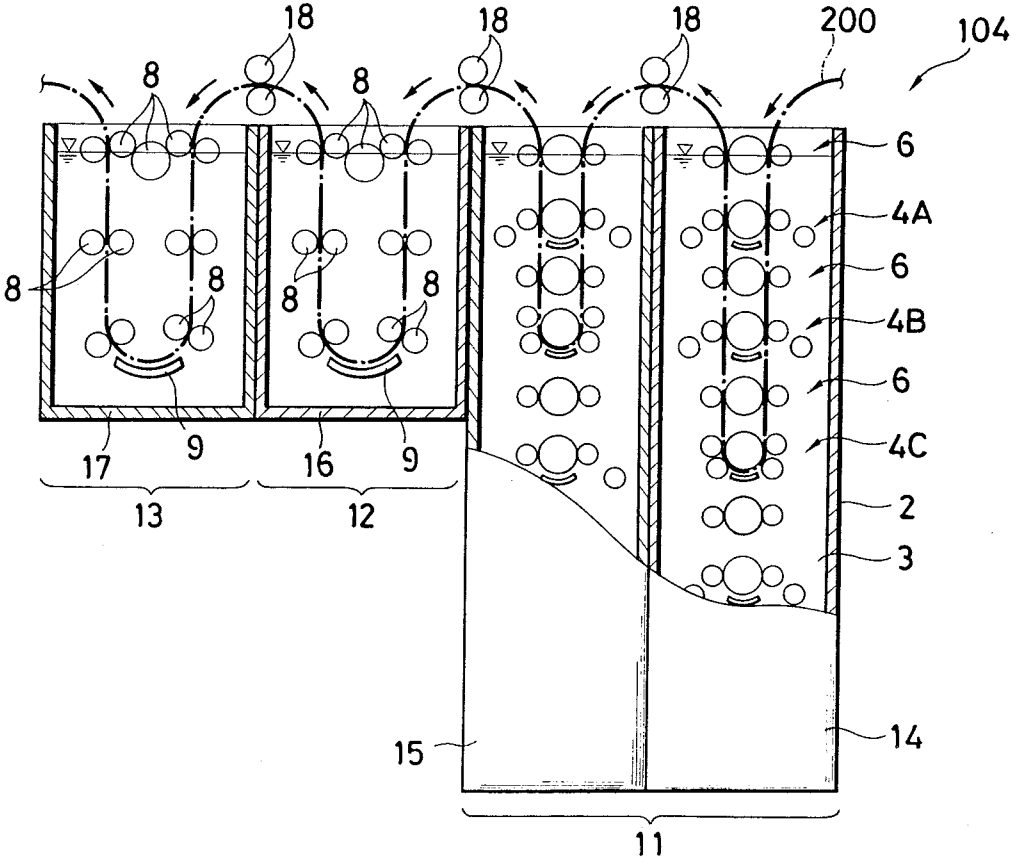
Figure 10:
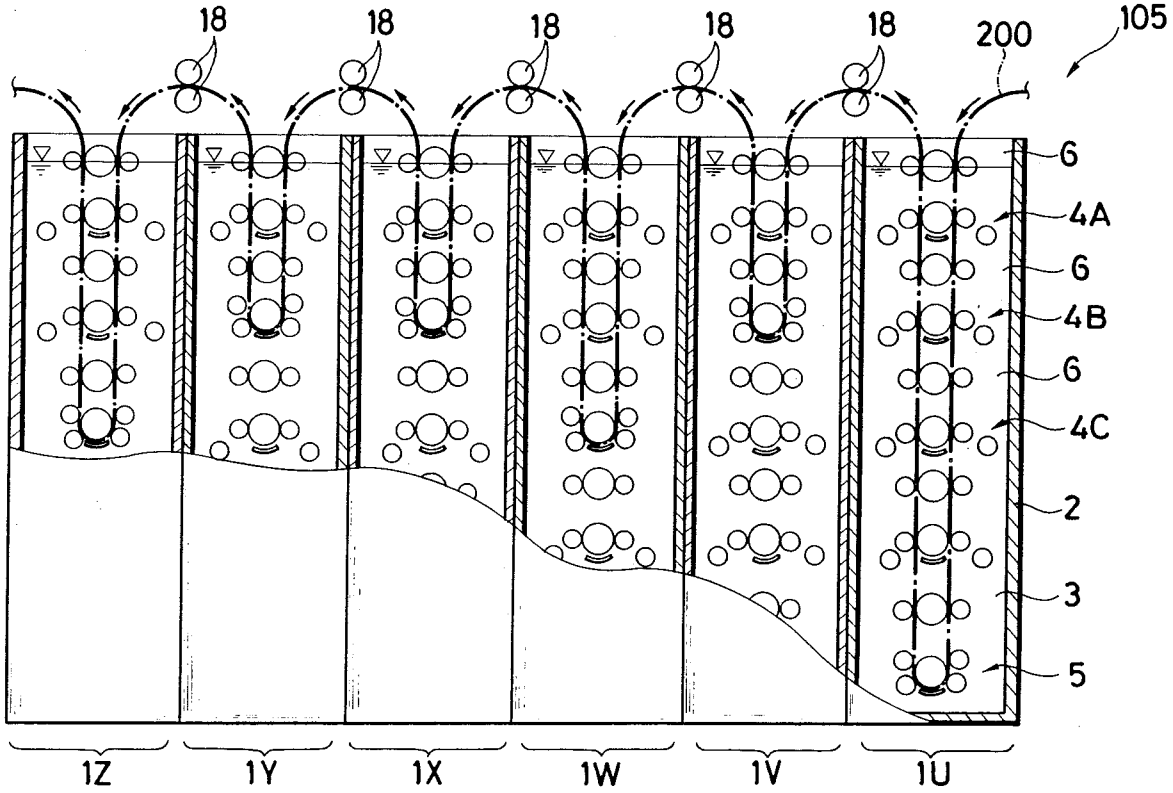

Now, description is made of the arrangement in which the photosensitive material processing apparatus mentioned above is applied to a processing zone of a copying machine. FIGS. 9 and 10 illustrate such arrangements.

In FIG. 9, a photosensitive material processing system generally designated at 104 includes a developing device 11, and a bleach-fix device 12 and a washing device 13 as post-processing devices, the devices juxtaposed in this order from the right. These devices have two developing tanks 14 and 15, a bleach-fix tank 16, and a washing tank 17, respectively. A photosensitive sheet 200 which has been exposed to an original image in an exposure zone (not shown) is developed by passing the sheet through the series of tanks.

The photosensitive material processing apparatus 101 (or 102 or 103) mentioned above is applied to the developing device 11 so that the path length for the photosensitive sheet 200 during development is variable. In the illustrated embodiment, the developing device 11 includes two developing tanks 14 and 15 to both of which the processing apparatus 101 of the invention is applied. The number of developing tanks and whether or not the processing apparatus 101 of the invention is applied to more than one tank are not limitative.

The bleach-fix and washing devices 12 and 13 are of the construction where the path length is fixed as in prior art photosensitive material processing apparatus. More particularly, the bleach-fix device 12 has a plurality of feed rollers 8 arranged in the tank 16 so as to define a predetermined path. Any desired drive means (not shown) drives all or some of these feed rollers 8 for rotation, causing the sheet 200 to travel in a direction as shown by arrows. A reverse guide 9 is disposed at the bottom of the tank for engaging the coming-down sheet 200 to turn it around from a downward to an upward direction.

The washing device 13 is of the same construction as the bleach-fix device 12.

Unlike the illustrated embodiment, either or both of the bleach-fix and washing devices 12 and 13 may consist of two or more tanks.

At each of the transitions between the developing tanks 14 and 15, the developing and bleach-fix tanks 15 and 16, and the bleach-fix and washing tanks 16 and 17 are disposed a pair of transition rollers 18 for conveying the sheet 200 from one tank to a subsequent tank. The transition rollers 18 also play the role of a squeezer for preventing processing solution from being entrained with the sheet from one tank to a subsequent tank.

It is desired particularly in a developing device to vary the path length for photosensitive material in order to effect sensitization or desensitization and/or to accomplish optimum development for two or more types of photosensitive material having different characteristics. Such a demand is satisfied by the system 104 in which the developing device 11 comprises the path length-variable processing apparatus 101 and the remaining devices, bleach-fix and washing devices 12 and 13 are of a conventional structure which is relatively small sized and simple. There is available a compact photographic developing system having improved performance and efficiency.

FIG. 10 illustrates another photosensitive material processing system also designated at 105 in which six photosensitive material processing apparatus 1U, 1V, 1W, 1X, 1Y and 1Z are juxtaposed in this order from the right. These apparatus 1U to 1Z are of the same construction as the path length-variable processing apparatus 101 (or 102 or 103) shown in FIG. 1 (or FIG. 2 or 3). A photosensitive sheet 200 which has been exposed to an original image in an exposure zone (not shown) is processed by passing the sheet through the series of tanks. Of course, the number of apparatus is not limited to six.

At each of the transitions between the adjoining apparatus are disposed a pair of transition rollers 18 for conveying the sheet 200 from one to a subsequent apparatus.

Selected sets of processing apparatus 1U to 1Z may be assigned to different purposes as shown in Table 2.

TABLE 2

| | Development | Bleach-fix | Washing |
|---|---|---|---|
| No. 1 | 1U, 1V, 1W, 1X | 1Y | 1Z |
| No. 2 | 1U, 1V, 1W | 1X, 1Y | 1Z |
| No. 3 | 1U, 1V | 1W, 1X | 1Y, 1Z |
| No. 4* | 1V | 1W | 1X, 1Y, 1Z |

*In No. 4, apparatus 1U is non-operative.

In a first example where it is desired to effect sensitizing development on photosensitive material, combination No. 1 is selected from Table 2 for the purpose of providing an increased path length for development. That is, four processing apparatus 1U, 1V, 1W, and 1X are assigned to development, and the remaining two processing apparatus 1Y and 1Z are assigned as bleach-fix and washing apparatus, respectively. In this case, it is preferred to set a relatively increased path length in the processing apparatus 1Y and 1Z which are bleach-fix and washing apparatus.

In a second example where it is desired to enhance washing in processing photosensitive material, combination No. 4 is selected from Table 2. That is, three processing apparatus 1X, 1Y, and 1Z are assigned to washing. It is acceptable that one or more apparatus are not in service as in combination No. 4.

The photosensitive material processing system 105 is of the design such that selected sets of six processing apparatus 1U to 1Z may be assigned to different purposes, typically as developing, bleach-fix and washing apparatus as shown in Table 2. Differently stated, since the system 105 has a plurality of processing apparatus destined for the sole or selected function of development, bleach-fix and washing, the system 105 can vary the path length over a wide range in each of the tanks with the minimized space that the system occupies. For example, the path length available for washing varies from the minimum value available with combination No. 1 using only one washing tank where a setting for first stage reversal is assumed (though this is impractical) to the maximum value available with combination No. 4 using three washing tanks where a setting for lowest stage reversal is assumed.

The photosensitive material processing system 105 also finds an application as a photographic developing apparatus for use in a laboratory experiment since the function of each of plural processing apparatus 1U to 1Z can be readily changed.

The function of processing apparatus 101 employed in the system 105 is not limited to the development, bleach-fix and washing mentioned above. A variety of photographic processings are contemplated herein including pre-treatment, bleaching, fixing, secondary development, reversal, compensation, stabilization, and stop.

The photosensitive material processing apparatus of the present invention will find a variety of uses such as wet copying machines, automatic developing machines, printer processors, video printer processors, photographic print producing vending machines, proof color paper processors, and laboratory testing equipment of these actual processors.

The type of photosensitive material which can be processed in the apparatus of the present invention is not particularly limited. Any desired types of photosensitive material may be processed, including color negative films, color reversal films, color photographic paper, color positive films, color reversal photographic paper, printing photographic photosensitive material, radiographic photosensitive material, black-and-white negative films, black-and-white photographic paper, and micro-film photosensitive material.

The photosensitive material processing apparatus of the present invention has the following benefits. Since provision is made for varying the length of the path that photosensitive material travels in the processing tank or solution, the duration of processing time can be varied without changing the feed speed. The photosensitive material can be properly processed within the minimum processing time independent of its type, developing characteristics, and size. A size reduction can also be expected.

In the photosensitive material processing system of the present invention, a plurality of such path length variable processing apparatus are arranged in series and assigned to different purposes. Since selected sets of apparatus can be assigned to different functions and the function of some apparatus is exchangeable, the path length available for a particular function can be varied over a wide range. The space that the system occupies is relatively small despite such combined functions.

While several preferred embodiments have been described, the invention is not limited thereto. Obviously many modifications and variations of the invention are possible in the light of the above teachings. It is therefore to be understood that within the scope of the appended claims, the invention may be practiced otherwise than as specifically described.

We claim:

1. A photosensitive material processing apparatus comprising:

a tank containing processing liquid therein; and means for passing photosensitive material through said liquid along a path having a variable length and having a plurality of vertically spaced-apart feed means which provide selectable reverse points, wherein said means for passing varies a length of said path by selecting a particular reverse point.

2. A photosensitive material processing apparatus comprising:

a tank containing processing liquid therein; and means for passing photosensitive material through said liquid along a path having a variable length and having a plurality of vertically spaced-apart feed means which provide selectable reverse points, wherein said means for passing varies a length of said path by selecting a particular reverse point;

and wherein said vertically spaced-apart feed means normally assumes a forward feed position for feeding said photosensitive material straight forward past said feed means, but is capable of assuming a reverse feed position for reversing a travel direction of said photosensitive material when selected, and control means for selecting one feed means which provides a desired path length and causing said selected feed means to assume a reverse feed position.

3. The apparatus of claim 1 or 2 wherein said means for passing photosensitive material through the liquid along a path having a variable length comprises a switchable roller unit disposed for vertical motion at one or more stages in the tank for advancing the photosensitive material, said switchable roller unit being capable of assuming a reverse position for turning back the photosensitive material from a downward to an upward travel direction and a forward position for allowing the photosensitive material to travel straight forward past the unit, and a fixed roller unit disposed at the lowest stage in the tank for turning back the photosensitive material from a downward to an upward travel direction.

4. The apparatus of claim 3 wherein said switchable roller unit includes a rotating main roller, a reverse guide disposed below the main roller, and a guide roller movable between the reverse position where the photosensitive material is turned back along the reverse guide and the forward position where the photosensitive material is fed straight forward.

5. The apparatus of claim 3 wherein said fixed roller unit includes a rotating main roller, a reverse guide disposed below the main roller, and a guide roller for guiding the photosensitive material such that it is turned back along the reverse guide.

6. The apparatus of claim 1 or 2 wherein said means for passing photosensitive material through the liquid along a path having a variable length comprises a plurality of vertically spaced-apart suction roller units in the tank, each of said suction roller units being capable of advancing and turning the photosensitive material around the unit from a downward to an upward travel direction while attracting the photosensitive material to the unit surface, and means for selectively actuating one of said suction roller units.

7. The apparatus of claim 6 wherein each of said suction roller units includes a rotating main roller in the form of a hollow cylinder having perforations in the circumferential surface, suction means for applying negative pressure to the interior space of the cylinder to develop a sufficient suction force to attract the photosensitive material to the perforated surface of the cylinder, and sector means for shielding those perforations in an upper half area from the negative pressure applied to the cylinder interior space.

8. The apparatus of claim 7 wherein said sector means includes suction adjusting means disposed at a location where the photosensitive material leaves the roller unit, for reducing the suction force due to the negative pressure.

9. A photosensitive material processing apparatus comprising:

a tank containing processing liquid therein; and means for passing photosensitive material through said liquid along a path having a variable length and having a movable reverse point, wherein said means for passing varies a length of said path by changing a location of said movable reverse point, and wherein said means for passing comprises a reverse roller unit disposed for vertical motion in said tank for advancing said photosensitive material while turning said photosensitive material from a downward to an upward travel direction, said reverse roller unit including a rotating main roller, a reverse guide disposed below said main roller, and a guide roller for introducing said photosensitive material between said main roller and said reverse guide to turn it back along said reverse guide.

10. A photosensitive material processing system comprising a plurality of photosensitive material processing apparatus as set forth in claim 1 or 9 arranged in series with respect to the passage of the photosensitive material, selected sets of apparatus being assigned to different processing purposes wherein said path length varying means is controlled for each of said photosensitive material processing apparatus whereby the duration of processing time for the photosensitive material is variable for each of said photosensitive material processing apparatus.

11. The system of claim 10 wherein at least one photosensitive material processing apparatus is assigned to developing and at least one photosensitive material processing apparatus is assigned to post-processing.

12. A photosensitive material processing system comprising a developing section for developing photosensitive material and a subsequent section for post-processing the developed material, wherein the developing section includes a photosensitive material processing apparatus as set forth in claim 1 or 9.

* * * * *